US007202473B2

(12) United States Patent
Bateman et al.

(10) Patent No.: US 7,202,473 B2
(45) Date of Patent: Apr. 10, 2007

(54) MASS SPECTROMETER

(75) Inventors: Robert Harold Bateman, Knutsford (GB); Jeff Brown, Cheshire (GB); Martin Green, Cheshire (GB)

(73) Assignee: Micromass UK Limited (GB)

( * ) Notice: Subject to any disclaimer, the term of this patent is extended or adjusted under 35 U.S.C. 154(b) by 183 days.

(21) Appl. No.: 10/821,548

(22) Filed: Apr. 9, 2004

(65) Prior Publication Data

US 2005/0023454 A1 Feb. 3, 2005

Related U.S. Application Data

(60) Provisional application No. 60/462,314, filed on Apr. 14, 2003.

(30) Foreign Application Priority Data

Apr. 10, 2003 (GB) ..... 0308278.1

(51) Int. Cl.
*H01J 49/00* (2006.01)
*H01J 49/40* (2006.01)

(52) U.S. Cl. ..... 250/288; 250/281; 250/282

(58) Field of Classification Search ..... 250/281, 250/288

See application file for complete search history.

(56) References Cited

U.S. PATENT DOCUMENTS 4,122,343 A * 10/1978 Risby et al. ..... 250/282
5,218,299 A * 6/1993 Dunkel ..... 324/307
5,300,771 A * 4/1994 Labowsky ..... 250/282
5,340,983 A * 8/1994 Deinzer et al. ..... 250/281
5,572,022 A * 11/1996 Schwartz et al. ..... 250/282
5,589,364 A * 12/1996 Williams et al. ..... 435/69.7
5,821,063 A * 10/1998 Patterson et al. ..... 435/6
6,203,990 B1 * 3/2001 Fahy ..... 435/6
6,229,142 B1 5/2001 Bateman et al.
6,373,052 B1 * 4/2002 Hoyes et al. ..... 250/287
6,437,325 B1 8/2002 Reilly et al.
6,777,181 B2 * 8/2004 Matsumoto ..... 435/6
6,821,734 B2 * 11/2004 Kambara et al. ..... 435/6
6,863,790 B1 * 3/2005 Moini et al. ..... 204/452
6,940,065 B2 * 9/2005 Graber et al. ..... 250/282
7,045,296 B2 * 5/2006 Parker et al. ..... 435/7.1
2002/0151707 A1 * 10/2002 Kindsvogel et al. ..... 536/23.5

(Continued)

FOREIGN PATENT DOCUMENTS

EP 1 542 002 A1 6/2005
GB 2363249 12/2001
JP 62124456 6/1987

OTHER PUBLICATIONS

Estimating The Precision Of Exact Mass Measurements On An Orthogonal Time of Flight Mass Spectrometer. Karl F. Blom, Anal. Chem. 2001, 73,715-719.

(Continued)

*Primary Examiner*—Nikita Wells
*Assistant Examiner*—Bernard Souw
(74) *Attorney, Agent, or Firm*—Anthony J. Janiuk; Jamie H. Rose

(57) ABSTRACT

A mass spectrometer is disclosed wherein the experimentally determined mass to charge ratios of ions are reported together with an error band for each mass to charge ratio determination. The error band may, for example, reflect a 95% probability or confidence that the real, true, actual or accepted mass to charge ratio of the ion lies within the error band. By accurately determining the error band the possible candidate ions in a database can be accurately restricted whilst also guarding against over restriction.

56 Claims, 6 Drawing Sheets

U.S. PATENT DOCUMENTS

2002/0192720 A1* 12/2002 Parker et al. ..... 435/7.9
2003/0064376 A1* 4/2003 Makarov et al. ..... 435/6
2003/0129657 A1* 7/2003 Decker et al. ..... 435/7.1
2004/0031918 A1* 2/2004 Schoen et al. ..... 250/282
2004/0169137 A1* 9/2004 Westphall et al. ..... 250/281
2005/0006577 A1* 1/2005 Fuhrer et al. ..... 250/287
2005/0023454 A1* 2/2005 Bateman et al. ..... 250/288
2005/0032104 A1* 2/2005 Makarov et al. ..... 435/6
2005/0098721 A1* 5/2005 Bateman et al. ..... 250/288
2005/0165575 A1* 7/2005 Mettes ..... 702/127
2006/0100792 A1* 5/2006 Natsume et al. ..... 702/22

OTHER PUBLICATIONS

Statistics. A Guide To The Use Of Statistical Methods in the Physical Sciences. R. J. Barlow, John Wiley & Sons Ltd., Chapter 4 entitled: Errors.

Statistics. A Guide To The Use Of Statistical Methods in the Physical Sciences. R. J. Barlow, John Wiley & Sons Ltd., Chapter 7, entitled: Probability and Confidence.

* cited by examiner

MASS SPECTROMETER

CROSS REFERENCE TO RELATED APPLICATIONS

This application claims priority from United Kingdom patent applications GB-0308278.1, filed 10 Apr. 2003, and U.S. Provisional Application 60/462,314, filed 14 Apr. 2003. The contents of these applications are incorporated herein by reference.

STATEMENT ON FEDERALLY SPONSORED RESEARCH

N/A

FIELD OF THE INVENTION

The present invention relates to a mass spectrometer and a method of mass spectrometry.

BACKGROUND OF THE INVENTION

Known mass spectrometers measure and report a value of mass to charge ratio for analyte ions in a sample. The determined mass to charge ratio is taken to be representative of the sum of the masses of the individual atoms present in an analyte molecule plus or minus the rest mass of one or more electrons (depending upon the charge state and polarity of the molecule when measured). The unit of mass to charge is based upon one mass unit being 1/12 of the mass of the most abundant isotope of carbon ($^{12}C$) and one unit of charge being equal to the charge of an electron.

Conventional mass spectrometers process mass spectral data and calculate the mass to charge ratio of detected ions. However, the accuracy of a mass to charge ratio measurement will be dependent upon the particular type of mass analyser used, the quantity of analyte sample and the conditions under which a particular sample is mass analysed.

Although some conventional mass spectrometers are able to measure the mass to charge ratio of an ion to a relatively high precision and accuracy, conventional mass spectrometers are not able to determine the accuracy of each individual mass to charge ratio measurement relating to an unknown sample.

However, without an estimate of the accuracy of a mass to charge ratio measurement it is uncertain what range of mass to charge ratio should be considered when using, for example, a database of atomic elements and their isotopes to determine possible elemental compositions which will have mass to charge ratios substantially similar to that of the analyte ion. Similarly, it will also not be known what range of mass to charge ratio should be considered when searching a database of known molecules to find a match for an analyte ion. It will be appreciated that if a relatively wide mass to charge ratio window needs to be considered then the number of possible candidate ions dramatically increases.

It is therefore desired to provide an improved method of mass spectrometry and an improved mass spectrometer.

SUMMARY OF THE INVENTION

According to an aspect of the present invention there is provided a mass spectrometer comprising:

a mass analyser; and a processing system, the processing system being arranged to obtain mass spectral data, to determine a mass to charge ratio of n different species of ion observed in the mass spectral data and to calculate a respective error band for the determined mass to charge ratio of each of the n different species of ion, wherein the probability or confidence that the real, true, actual or accepted mass to charge ratio of a species of ion falls within its respective calculated error band is greater than or equal to x %.

According to different embodiments of the present invention n may be 1, 2–5, 5–10, 10–15, 15–20, 20–25, 25–30, 30–35, 35–40, 40–45, 45–50, ≧50, ≧60, ≧70, ≧80, ≧90 or ≧100.

According to less preferred embodiments x may be <1, 1–5, 5–10, 10–15, 15–20, 20–25, 25–30, 30–35, 35–40, 40–45, 45–50. According to more preferred embodiments x may be 50–55, 55–60, 60–65, 65–70, 70–75, 75–80, 80–85 or 85–90. According to particularly preferred embodiments x may be 90–91, 91–92, 92–93, 93–94, 94–95, 95–96, 96–97, 97–98, 98–99, 99–99.5, 99.5–99.95, 99.95–99.99 or 99.99–100.

The mass spectrometer may further comprise means for reporting the mass to charge ratio of at least some of the n species of ion together with the respective calculated error band for each mass to charge ratio.

The mass spectral data preferably comprises data relating to the time that different species of ion were detected. The data relating to the time that different species of ion were detected is preferably converted into data relating to the mass to charge ratio of the ions. The data relating to the time that different species of ion were detected is preferably converted into data relating to the mass to charge ratio of the ions by using a calibration function.

As part of the process of calculating a respective error band for the determined mass to charge ratio of each of the n different species of ion the processing system may estimate, in use, the systematic error in determining the mass to charge ratio of the ions.

The processing system preferably estimates, in use, the accuracy of a mathematical model used in mass calibration. According to an embodiment the error due to mass calibration may be estimated.

The error due to using one or more internal references or calibrants may be estimated. Preferably, as part of the process of calculating a respective error band for the determined mass to charge ratio of each of the n different species of ion the processing system monitors for changes in the time of detection of one or more internal references or calibrants.

According to an embodiment the stability or instability of the mass spectrometer subsequent to mass calibration may be estimated. Preferably, as part of the process of calculating a respective error band for the determined mass to charge ratio of each of the n different species of ion the processing system estimates, in use, the error due to drift of the mass spectrometer subsequent to mass calibration. The effect of changes in the operating conditions of the mass spectrometer subsequent to mass calibration may be estimated.

According to another embodiment the effect of user intervention subsequent to mass calibration is estimated. The effect of external influences on the mass spectrometer subsequent to mass calibration may also be estimated. According to a yet further embodiment the effect of the stability or instability of a power supply of the mass spectrometer subsequent to mass calibration is estimated. Preferably, as part of the process of calculating a respective error band for the determined mass to charge ratio of each of the n different species of ion the processing system estimates, in use, the effect of changes in temperature on the mass spectrometer subsequent to mass calibration.

The effect of changes in interference subsequent to mass calibration may be estimated. The interference may be due to one or more internal reference or calibrant ions interfering with one or more analyte ions. The interference may be due to one or more analyte ions interfering with one or more internal reference or calibrant ions. The interference may be due to one or more background or chemical noise ions interfering with one or more internal reference or calibrant ions. Alternatively/additionally, the interference may be due to one or more background or chemical noise ions interfering with one or more analyte ions.

As part of the process of calculating a respective error band for the determined mass to charge ratio of each of the n different species of ion the processing system may estimate, in use, the time elapsed since the mass spectrometer was last calibrated. The processing system may also estimate, in use, the effect of thermal expansion of one or more components of the mass spectrometer subsequent to mass calibration.

According to another embodiment the processing system may estimate, in use, the error due to space charge repulsion effects within the mass spectrometer. The error due to space charge repulsion effects may be determined at least in part by consideration of the observed intensity of one or more species of ions.

As part of the process of calculating a respective error band for the determined mass to charge ratio of each of the n different species of ion the processing system may estimate, in use, the error recorded during mass calibration.

According to a particularly preferred embodiment the processing system may estimate, in use, the statistical error or random error in determining the mass to charge ratio of the ions. In particular, the processing system may estimate, in use, the uncertainty or standard deviation of the time of detection of one or more species of ion. According to a less preferred embodiment, particularly using a Fourier Transform Ion Cyclotron Resonance mass analyser the processing system may estimate, in use, the uncertainty or standard deviation of the frequency of detection of one or more species of ion.

Preferably, as part of the process of calculating a respective error band for the determined mass to charge ratio of each of the n different species of ion the processing system estimates, in use, the error due to ion detection statistics. The processing system may estimate, in use, the error due to insufficient sampling.

According to another embodiment, as part of the process of calculating a respective error band for the determined mass to charge ratio of each of the n different species of ion the processing system estimates, in use, the error due to computational errors. Preferably, as part of the process of calculating a respective error band for the determined mass to charge ratio of each of the n different species of ion the processing system estimates, in use, the error due to rounding off errors.

The processing system may estimate, in use, the error in a report exception situation wherein one or more species of ion within the mass spectral data are sufficiently corrupted or suffering from interference that the calculated respective error band of the ions is not reported.

As part of the process of calculating a respective error band for the determined mass to charge ratio of each of the n different species of ion the processing system may estimate, in use, the error due to mass interference wherein background or interference ions having substantially similar mass to charge ratios to analyte ions affect the ability of resolving the analyte ions from the background or interference ions. The error due to mass interference may be estimated by comparing the shape of an observed mass peak from the mass spectral data with the shape of a theoretical mass peak. The error due to mass interference may, for example, be estimated by comparing the deviation of the shape of an observed mass peak with either a Gaussian distribution, a cosine squared distribution, another mathematical function, or a profile derived from the shape of one or more mass peaks of one or more internal reference or calibrant ions.

According to another embodiment as part of the process of calculating a respective error band for the determined mass to charge ratio of each of the n different species of ion the processing system estimates, in use, the error due to saturation of a detector. According to another embodiment the processing system may estimate, in use, the error due to signal amplification saturation. According to another embodiment the processing system may estimate, in use, the error due to deadtime effects or missed counts of an ion counting detector.

As part of the process of calculating a respective error band for the determined mass to charge ratio of each of the n different species of ion the processing system may estimate, in use, the error due to the response of an ion detector.

According to another embodiment the processing system estimates, in use, the error due to the response of an electron or photon multiplier.

The processing system preferably combines multiple estimates of different errors. The multiple estimates of different errors are preferably combined by adding the estimates in quadrature.

According to a preferred embodiment the mass spectrometer further comprises means arranged to search in use a database to look for one or more ions known to have mass to charge ratios within a range which is related to the determined mass to charge ratio of one or more ions and the respective calculated error band for the determined mass to charge ratio. The database may comprise details of biopolymers, proteins, peptides, polypeptides, oligionucleotides, oligionucleosides, amino acids, carbohydrates, sugars, lipids, fatty acids, vitamins, hormones, portions or fragments of DNA, portions or fragments of cDNA, portions or fragments of RNA, portions or fragments of mRNA, portions or fragments of tRNA, polyclonal antibodies, monoclonal antibodies, ribonucleases, enzymes, metabolites, polysaccharides, phosphorolated peptides, phosphorolated proteins, glycopeptides, glycoproteins or steroids. Additionally/alternatively, the database may comprise details of the Electron Impact mass spectra of compounds. For example, the Wiley and/or NBS libraries may be searched.

According to an embodiment the mass spectrometer further comprises means for calculating elemental compositions having mass to charge ratios within a calculated error band of the determined mass to charge ratio of one or more species of ion. The elemental compositions are preferably calculated using the known masses or mass to charge ratios of atomic elements or groups of elements and/or their isotopes.

According to an embodiment the processing system is arranged, in use, to define one or more compounds of interest and to interrogate at least some of the determined mass to charge ratios and respective calculated error bands of at least some of the different species of ion observed in the mass spectral data to see whether the one or more compounds of interest fall within the error band of at least some of the different species of ion.

According to an embodiment the processing system is arranged, in use, to define one or more mass to charge ratios of interest and to interrogate at least some of the determined mass to charge ratios and respective calculated error bands of at least some of the different species of ion observed in the mass spectral data to see whether the one or more mass to charge ratios of interest fall within the error band of at least some of the different species of ion.

According to an embodiment the processing system is arranged, in use, to define one or more compounds of interest and to interrogate at least some of the determined mass to charge ratios and respective calculated error bands of different species of ion observed from a plurality of mass spectra acquired over a period of time to see whether the one or more compounds of interest fall within the error band of at least some of the different species of ion observed from the plurality of mass spectra.

According to an embodiment the processing system is arranged, in use, to define one or more mass to charge ratios of interest and to interrogate at least some of the determined mass to charge ratios and respective calculated error bands of different species of ion observed from a plurality of mass spectra acquired over a period of time to see whether the one or more mass to charge ratios of interest fall within the error band of at least some of the different species of ion observed from the plurality of mass spectra.

The mass spectrometer preferably further comprises an Electrospray ("ESI") ion source, an Atmospheric Pressure Chemical Ionisation ("APCI") ion source, an Atmospheric Pressure Photo Ionisation ("APPI") ion source, a Laser Desorption Ionisation ("LDI") ion source, an Inductively Coupled Plasma ("ICP") ion source, an Electron Impact ("EI) ion source, a Chemical Ionisation ("CI") ion source, a Field Ionisation ("FI") ion source, a Fast Atom Bombardment ("FAB") ion source, a Liquid Secondary Ion Mass Spectrometry ("LSIMS") ion source, an Atmospheric Pressure Ionisation ("API") ion source, a Field Desorption ("FD") ion source, a Matrix Assisted Laser Desorption Ionisation ("MALDI") ion source or a Desorption/Ionisation on Silicon ("DIOS") ion source. The ion source may be a continuous ion source or a pulsed ion source.

The mass spectrometer preferably comprises a Time of Flight mass analyser, a quadrupole mass analyser, a Penning or Fourier Transform Ion Cyclotron Resonance ("FTICR") mass analyser, a 2D or linear quadrupole ion trap or a Paul or 3D quadrupole ion trap.

According to another aspect of the present invention there is provided a method of mass spectrometry comprising:

obtaining mass spectral data using a mass spectrometer;

determining a mass to charge ratio of n different species of ion observed in the mass spectral data; and calculating a respective error band for the determined mass to charge ratio of each of the n different species of ion, wherein the probability or confidence that the real, true, actual or accepted mass to charge ratio of a species of ion falls within its respective calculated error band is greater than or equal to x %.

The preferred embodiment is particularly advantageous in that an understanding of the error in a mass to charge ratio measurement and the overall confidence in the mass to charge ratio assignment for an ion is particularly useful if the mass assignment is to be used, for example, to infer information about the elemental composition of the ion.

The preferred embodiment relates to automatically estimating and optionally reporting the expected or estimated accuracy of individual mass to charge ratio measurements. This is not something which conventional mass spectrometers are capable of doing.

The preferred embodiment automatically provides an estimate of the accuracy to be expected for individual mass to charge ratio measurements of unknown samples. This provides accurate limits of mass to charge ratio within which candidate elemental compositions may lie in, for example, a database of analyte ions. Estimating the accuracy of an assignment of mass to charge ratio to observed analyte ions also provides a measure of confidence in such elemental composition assignments. It provides both a means of restricting the range of possible elemental compositions which may need to be considered and also guards against over restriction thereby reducing the possibility of erroneous assignment of elemental composition. The preferred embodiment is also particularly advantageous when searching against mass to charge ratios in a library of known ions having known mass to charge ratios.

The precision of a mass to charge ratio measurement is dependent upon the scatter of measured values and the number of measurements. For a normal distribution of measurements the precision may be estimated from the standard deviation $\sigma$ of measurements about the mean and the number of measurements n. The accuracy of a particular mass to charge ratio measurement is the difference between the mean of the mass to charge ratio measurements and the true, actual, real or accepted mass to charge ratio of the analyte ion. In general, the more accurate the measurement of mass to charge ratio the smaller the band of uncertainty and hence the more restricted the range of possible elemental compositions which have mass to charge ratios which fall within this band of uncertainty.

Conventional mass spectrometers and in particular Fourier Transform Ion Cyclotron Resonance mass spectrometers, double focusing magnetic sector mass spectrometers, orthogonal and axial Time of Flight mass spectrometers and RF quadrupole mass filter mass spectrometers are capable of measuring the mass to charge ratio of an ion to within a few parts per million (ppm) of the true mass to charge ratio. Although such mass spectrometers are able to measure mass to charge ratio with a high degree of precision and accuracy, no estimate of the accuracy of individual mass to charge ratio measurements is possible.

Without an estimate of the accuracy of a mass to charge ratio measurement the value or worth of such a mass to charge ratio measurement is unknown. An understanding of the possible error in a mass to charge ratio measurement and an estimate of the confidence or otherwise in the mass to charge ratio assignment for an individual ion is particularly beneficial if the mass to charge ratio assignment is to be used to infer information about the elemental composition of the ion.

The preferred embodiment allows the mass to charge ratio window used to calculate proposed elemental compositions to be automatically restricted.

The preferred estimation of mass to charge ratio accuracy may also be used to appropriately set a search window when trying to match the measured mass to charge ratio or mass of an analyte ion to details of ions or molecules held in a library of ions or molecules having known mass to charge ratios or masses.

BRIEF DESCRIPTION OF THE DRAWINGS

Various embodiments of the present invention will now be described, by way of example only, and with reference to the accompanying drawings in which.

DETAILED DESCRIPTION OF THE INVENTION

A preferred embodiment of the present invention will now be described. The preferred embodiment involves arriving at a representative value for the precision and accuracy of an individual mass to charge ratio measurement. In order to do this multiple sources of error are preferably estimated and at least some of these errors are then combined and reported along with each individual mass to charge ratio measurement.

Some of the sources of error involved with an individual mass to charge ratio measurement which are preferably estimated include statistical or random errors such as errors due to ion detection statistics, errors due to insufficient sampling frequency, computational errors (e.g. rounding off errors) and errors recorded during mass calibration.

In some cases data may be sufficiently corrupted that no estimate of mass measurement error may be reliably calculated or reported. These situations include the effects of mass interferences, detector saturation and errors due to instability or drift of the mass spectrometer subsequent to calibration or in between calibrations.

Figure 1:
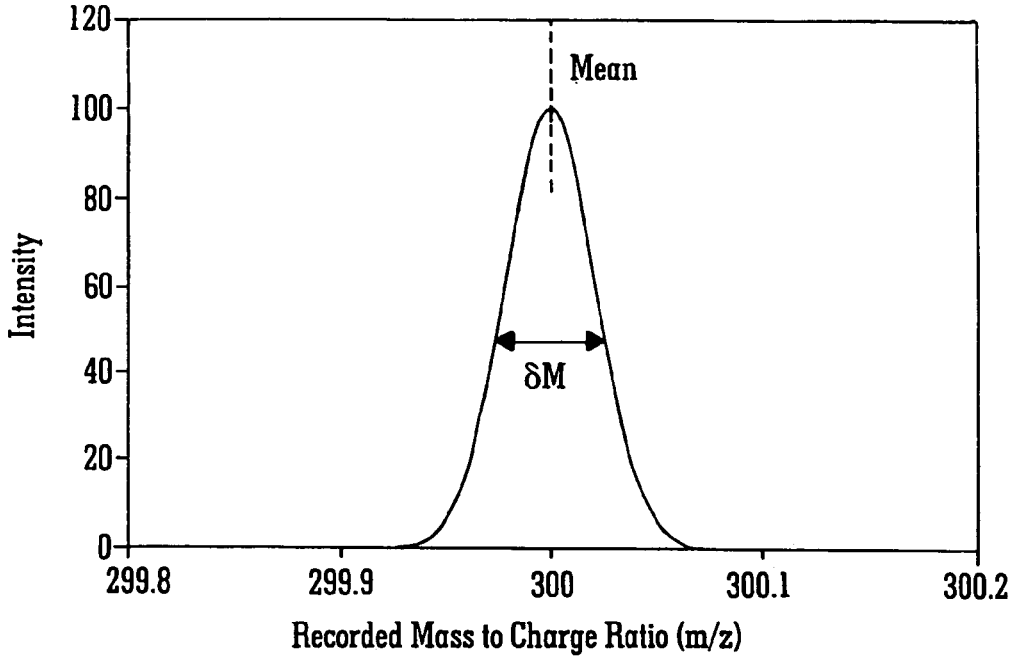
FIG. 1 shows a theoretical mass spectral peak.

Random error in the determination of the mass to charge ratio of an ion is often dominated by ion statistics. A mass spectral peak in a mass spectrum is the result of detecting a number of ions generated from an ion source. An example of a theoretical mass peak is shown in FIG. 1. FIG. 1 shows a theoretical mass peak which may be observed for ions having a mass to charge ratio of 300. The detected ions which are all the same species of ion will have a distribution of mass to charge ratios centred around a mean value and will fall within a defined mass envelope. The narrower the mass or peak envelope the more able a mass spectrometer is to distinguish between ions with very small differences in mass to charge ratio. The mass resolution R may be defined as:

$$R = \frac{M}{\delta M}$$

where M is the mass to charge ratio of the mean of a mass or peak envelope and δM is the width of the mass or peak envelope in mass units defined in a specific way e.g. at the Full Width Half Maximum (FWHM). The mean of this distribution is the estimation of the mass to charge ratio for the observed mass peak.

If the gain characteristics of the detection and amplification system are known, then the area of the mass spectral peak may be expressed in terms of the absolute number of ions within the mass or peak envelope.

Figure 2:
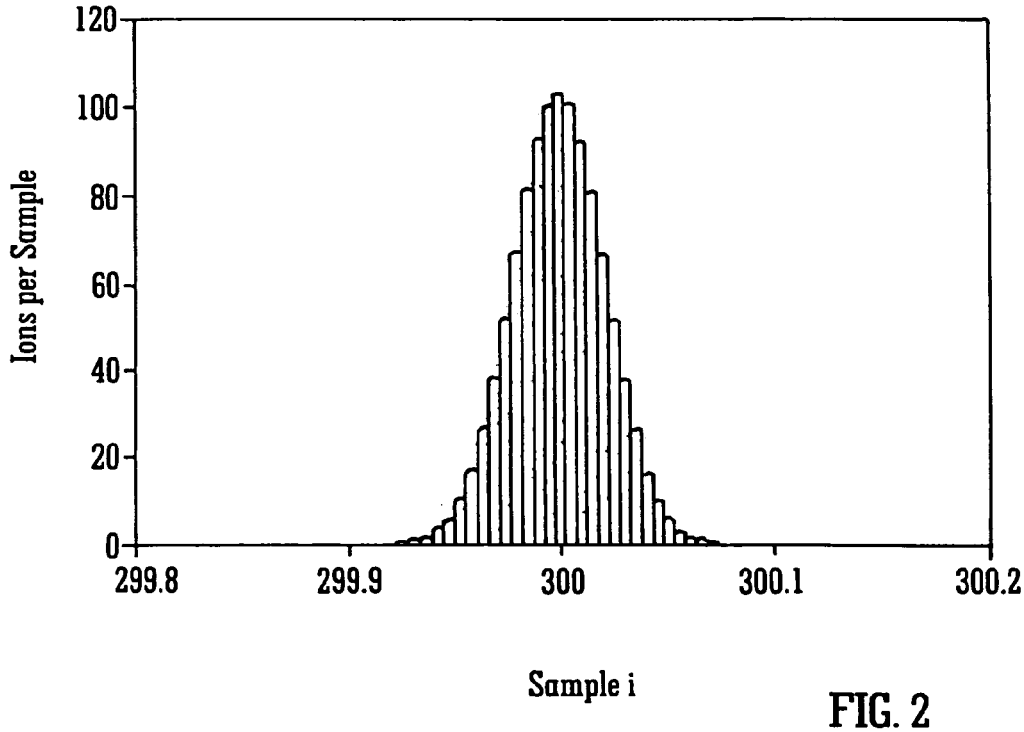
FIG. 2 shows the theoretical mass spectral peak in which the mass to charge ratio axis has been divided into discrete samples.

In FIG. 2 the mass to charge ratio scale has been divided into a plurality of discrete samples. Each sample is described by an index number i and each index number i is associated with a value of mass to charge ratio $M_i$. For simplicity, it has been assumed that the y axis represents the absolute number of ions $I_i$ measured at each particular value of mass to charge ratio $M_i$. It is also assumed that each ion detected gives rise to a signal of the same amplitude. The mean of this distribution $M_{mean}$ is given by:

$$M_{mean} = \frac{\sum_i I_i \cdot M_i}{\sum I_i}$$

where $$\sum_i I_i = N$$

and N is the total number of ions detected. The mean represents the measured mass to charge ratio value of the peak.

The mass spectral peak shown in FIG. 2 may be considered as a probability distribution with a parent population variance V of ion arrivals which can be estimated from:

$$V = \frac{\sum_i I_i (M_i - M_{mean})^2}{N - 1}$$

The standard deviation $\sigma_M$ around the mean for this parent population is given by:

$$\sigma_M = \sqrt{V}$$

From theoretical statistics, if the mass to charge ratio value is measured based upon a single recorded ion belonging to this distribution then the value $M_i$ recorded for this ion will be the most likely estimate of the mean of the distribution. The estimated uncertainty in this single measurement is given by $\sigma_M$.

If the measurement is repeated for N single ions an average mean value can be produced. This average mean value will have an uncertainty or standard deviation $\sigma_c$ of:

$$\sigma_c = \frac{\sigma_M}{\sqrt{N}}$$

where $\sigma_c$ represents the standard deviation on the measurement of the center of a mass spectral peak with a parent population standard deviation of $\sigma_M$ and containing N ions.

The expressions above can be related to any peak shape. However, the shape of a typical mass spectral peak may be approximated by a Gaussian distribution. Assuming a Gaussian distribution and δM defined at Full Width Half Maximum (FWHM) then:

$$\sigma_M = \frac{\delta M}{2.35}$$

This allows the uncertainty in the centroid determination of the peak to be expressed in terms of δM and the number of ions recorded N. The expression below yields the uncertainty in the measurement in mass units:

$$\sigma_c = \frac{\delta M}{\sqrt{5.5 \cdot N}}$$

From integration of the Gaussian probability distribution function, approximately 95% of measurements for a given δM and N will fall within $+/-2\sigma_c$. This spread is referred to as the 95% confidence limit.

The equations derived above describe the statistical limitations of peak centroid determination in a situation where every ion detected gives an identical response.

Typically mass spectrometers employ multiplier systems to amplify the signal from the individual ions to ensure detection. These multipliers include electron multipliers, photo multipliers and microchannel plates in a variety of configurations and are often used in conjunction with electronic amplification devices. Due to the statistical characteristics of some of these devices, ions having the same mass to charge ratio will have a response governed by a separate probability distribution function. When employing an analogue, signal recording system (e.g. an Analogue to Digital Recorder ADC) this distribution leads to an increase in the uncertainty of the determination of the centre of a mass spectral peak. This increase may be calculated if the distribution of ion response is well characterized and may then be incorporated into the estimation of error. When using an ion counting system (e.g. a Time to Digital Recorder TDC) this effect does not need to be considered.

In some cases there may be insufficient samples over a mass spectral peak to accurately determine its center. This error should ideally be minimized. However, if it is significant then it should preferably be incorporated into any final quantification of overall error.

When measuring mass to less than 1/1000 of a mass unit (commonly referred to as milli dalton (mDa)) it is important that calculations are performed and presented with a suitable number of decimal places to avoid unnecessary rounding errors. For example, if an ion having a mass to charge ratio of 50 is mass measured and the result rounded to four decimal places then the possible error due to this rounding will be 50.0000±0.00005. Expressed in parts per million (ppm) this is 50±1 ppm.

Calibration involves introducing a reference compound or mixture of reference compounds which give rise to mass spectral peaks which have precisely known elemental compositions and hence which have precisely known mass to charge ratios. The experimentally measured mass to charge ratio value for each of the calibration peaks are then compared to the known reference mass to charge ratio values and a suitable calibration function or functions can then be applied to subsequent experimental data. The calibration function ensures that an unknown sample is correctly calibrated as far as is possible. The purpose of this calibration function is to adjust the measured mass to charge ratio value of reference ions to be as close as possible to the theoretical mass of the reference compound.

As long as statistical errors are low this procedure will compensate for any systematic errors which are present. Systematic errors in mass measurement are biases in the measured value which remain the same no matter how many times the measurement is repeated. Any residual errors remaining after calibration may be treated as random errors.

Ideally, during calibration, sufficient signal should be acquired such that statistical error due to an insufficient number of ions is negligible. This may not, however, always be possible.

From the statistical expressions developed above it is possible to assign a value of centroid standard deviation to each peak in the calibration. This may be used to apply appropriate weighting to each mass to charge ratio value when fitting a calibration function or functions to the calibration data. This information may be used to predict how errors due to statistics in the initial calibration will affect the uncertainty in the final analyte mass measurement. This is illustrated further with reference to FIGS. 3–5.

Figure 3:
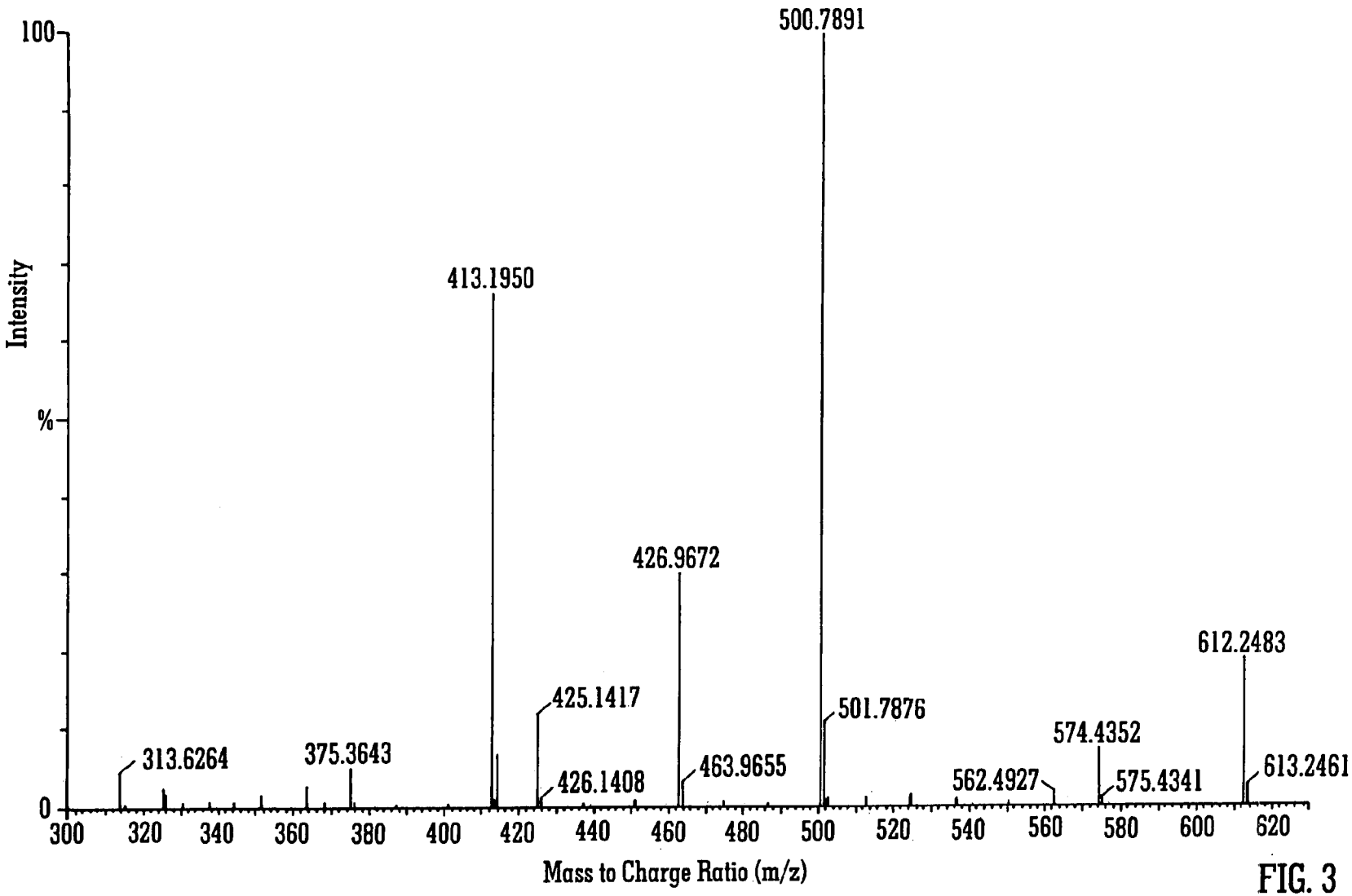
FIG. 3 shows an uncalibrated mass spectrum of a reference compound PFTBA.

FIG. 3 shows an un-calibrated fragment ion mass spectrum over the mass to charge ratio range 300–620 resulting from a reference compound Perfluorotributylamine (PFTBA) acquired using an Electron Impact ("EI") ion source operated in positive ion mode. The ions were analysed using an orthogonal acceleration Time of Flight mass analyser. PFTBA is a common reference material for Electron Impact mass spectrometry studies. As a result of the ionisation process the molecular ion having a nominal mass to charge ratio of 671 was fragmented into a number of different fragment ions having different mass to charge ratios. The molecular ion is not therefore observed in the resulting fragmentation mass spectrum a portion of which is shown in FIG. 3.

With orthogonal acceleration Time of Flight mass analysers the mass to charge ratio value is proportional to the square of the time of flight of ions in a drift or flight region of the mass analyser. By comparing the square root of the flight time of a reference ion to the known mass to charge ratio of the reference ion, a relationship between time of flight and mass to charge ratio can be established. This relationship may then be used to generate a calibration expression based on a third order polynomial expression using a weighted least squares method.

Figure 4:
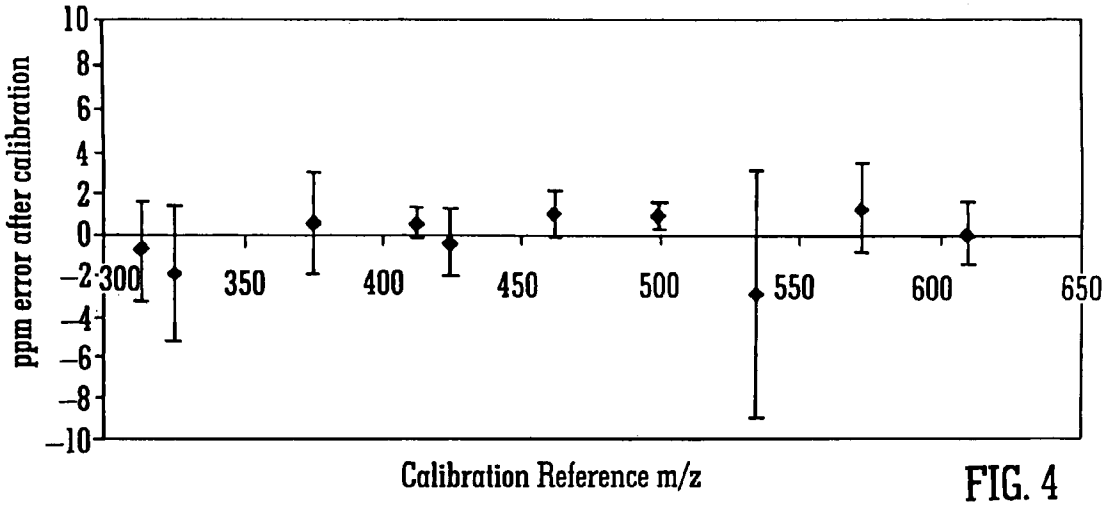
FIG. 4 shows how residual errors after mass calibration may be quite high if the mass spectrometer is only calibrated using a relatively small amount of data.

FIG. 4 shows the residual errors after generating such a calibration expression based upon a relatively small amount of data. In FIG. 4 the x axis indicates the calculated mass to charge ratios of different fragment ions derived from PFTBA based upon their known empirical formula. The y axis represents the difference between the calibrated mass to charge ratio of the fragment ions and the known reference mass to charge ratio values after calibration had been applied. The axis is displayed in parts per million error (ppm). The vertical lines represent $+/-2\sigma_c$ where $\sigma_c$ is the statistical uncertainty in the peak center determination in ppm. These error bars represent the calculated scatter which could be expected from the reported mass to charge ratio value from repetitive measurements of each calibration point within a 95% confidence limit. The error bars are inversely proportional to the square root of the intensity.

Figure 5:
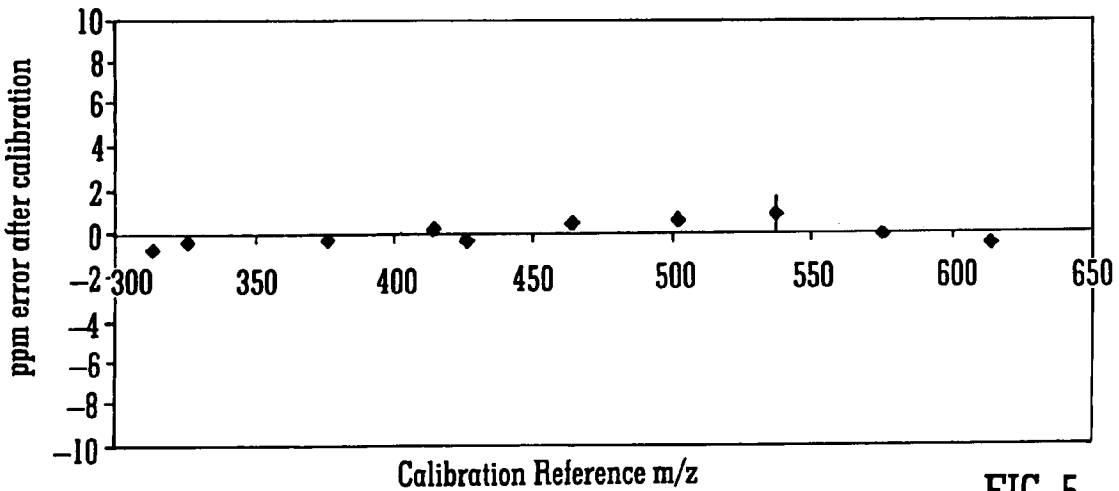
FIG. 5 shows how the residual errors after mass calibration will be smaller but not insignificant if the mass spectrometer is calibrated using a relatively large amount of data.

FIG. 5 shows a similar plot but obtained using a much larger data set. The error bars are very small but they are nonetheless still present and the total error is now less than +/−1 ppm over the entire range. The deviation of the calibrated results from the calculated result reflects a remaining element of systematic error. This error may be further reduced by employing a higher order polynomial expression or an alternative curve fitting method.

The results shown in FIGS. 4 and 5 were taken from the same experimental run. PFTBA was continuously infused into the ion source and mass spectra were acquired at a rate of one mass spectrum per second. Data from multiple mass spectra were averaged prior to calibration. FIG. 4 shows the error for an average of 20 s of data collection whereas FIG. 5 shows the error for an average of 30 minutes of data collection. The results shown in FIG. 5 therefore represent a data set which is approximately x90 that of the data set used in FIG. 4. The error bars, which are based on ion statistics alone are approximately x9.5 (square root of 90) times smaller in FIG. 5 than in FIG. 4.

Because of the variation in signal intensity it can be seen from FIG. 4 that the error due to statistics within the calibration varies for different mass regions. The errors in this case are dominated by the calculated statistical error on each data point.

In the specific example of calibrating a Time of Flight mass spectrometer coefficients have been calculated of a third order polynomial of the form:

$$\sqrt{M_{\mathrm{ref}(i)}}=a+b\cdot\sqrt{M_{est(i)}}+c\cdot(\sqrt{M_{\mathrm{est}(i)}})^2+d\cdot(\sqrt{M_{\mathrm{est}(i)}})^3$$

where $M_{ref(i)}$ is the calculated mass to charge ratio value of reference peak i based on the known empirical formula and $M_{est(i)}$ is the mass to charge ratio value of reference peak i recorded before calibration.

The method involves minimizing the sum of the squared difference between the estimated mass to charge ratio values $M_{est(i)}$ and the calculated mass to charge ratio value of the reference material $M_{ref(i)}$ weighted by the calculated statistical variance $\sigma_{c(i)}^2$ of each estimated measurement where i is an index denoting individual points in the calibration and N is the total number of points in the calibration. This sum is denoted by the symbol $\chi^2$:

$$\chi^2=\sum_{i=1}^{N}\left[\frac{M_{ref(i)}-f(M_{est(i)})}{\sigma_{c(i)}}\right]^2$$

where:

$$f(M_{est(i)})=a+b\cdot\sqrt{M_{est(i)}}+c\cdot(\sqrt{M_{\mathrm{est}(i)}})^2+d\cdot(\sqrt{M_{\mathrm{est}(i)}})^3$$

The coefficients of the polynomial function are adjusted to give the lowest value of $\chi^2$. The $\chi^2$ value gives an overall estimation of the goodness of fit of the calibration expression and can be used to provide crude acceptance or rejection criteria for a given calibration.

Other goodness of fit tests may be performed on this type of data depending on the number of calibration points and the calibration approach followed. In principle other methods may be used for rejection or acceptance of calibration.

Using the method of least squares fitting above, the variance in the calculated coefficients in the polynomial expression can be calculated along with the covariance. This information can be used to calculate the variance and hence standard deviation of a measurement of any mass to charge ratio within the mass to charge ratio range of this calibration. This standard deviation may be combined with other statistical information to give an overall estimated error in a subsequent measurement.

Although the method of calibration described above uses a least squares $n^{th}$ order polynomial, other calibration schemes may be employed such as, for example, non-linear and linear regression and splines. These may be more suited to particular types of data or mass analysers. In each case it is possible to extract information about the predicted error at particular mass to charge ratio values based on the statistics of the individual calibrant peaks.

There are many potential sources of systematic error involved with mass measurement. However, many of these biases are constant during an experiment and can be removed from the final result by careful characterization of the system. This characterization, or calibration, is essential to ensure that the subsequent measurement is as accurate as possible. If a systematic error is identified that cannot be quantified then no reliable estimate of overall accuracy can be presented.

Some sources of systematic error may not be constant during the course of a measurement or may not be accurately predicted and corrected for during calibration. An example of this is an unresolved mass interference.

Figure 6:
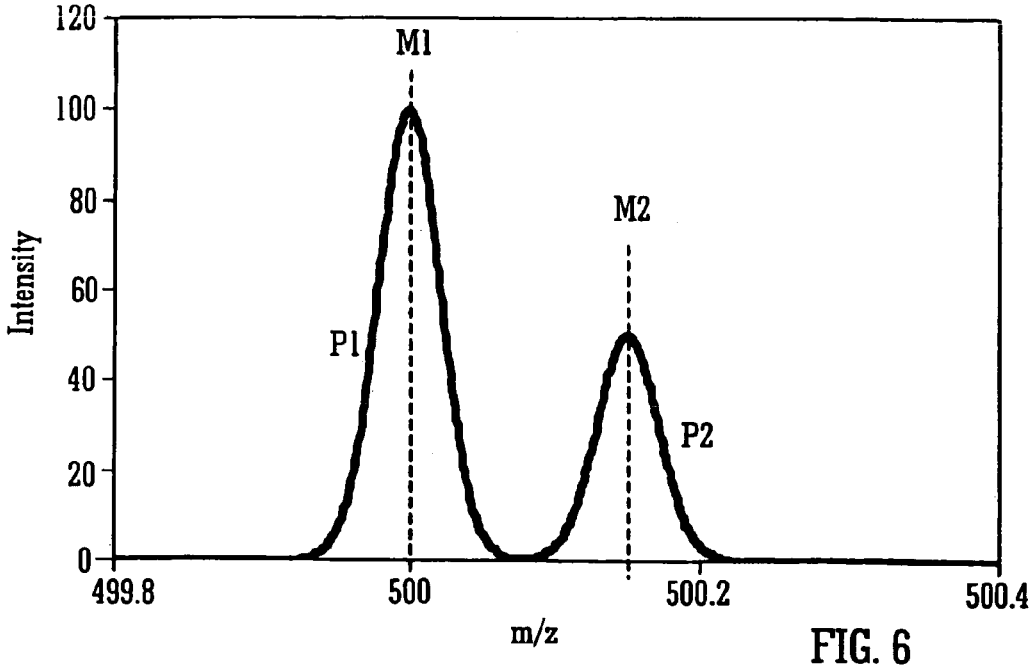
FIG. 6 shows a portion of a mass spectrum wherein a resolution of 10,000 is sufficient to resolve two different ions.

FIG. 6 shows a mass spectrum wherein the statistical error is assumed to be negligible. Two mass peaks are shown corresponding to two different ion species. The two mass peaks are assumed to have a Gaussian distribution. The first mass peak P1 has a mean mass to charge ratio value of M1. The second mass peak P2 has a mean mass to charge ratio value of M2. The intensity of the second peak P2 is set to be half that of the first mass peak P1. Both mass peaks P1, P2 have a width at half height δM of 0.05 mass units. The mass resolution is therefore 10,000 (FWHM definition). In the particular example shown in FIG. 6 M1 is 500.0000 and M2 500.1500 i.e. the separation between M1 and M2 is 0.15 mass units. It is clear that a resolution of 10,000 is more than sufficient to separate the two different peaks P1, P2 and to enable accurate determination of the mean value of the peaks M1, M2.

Figure 7:
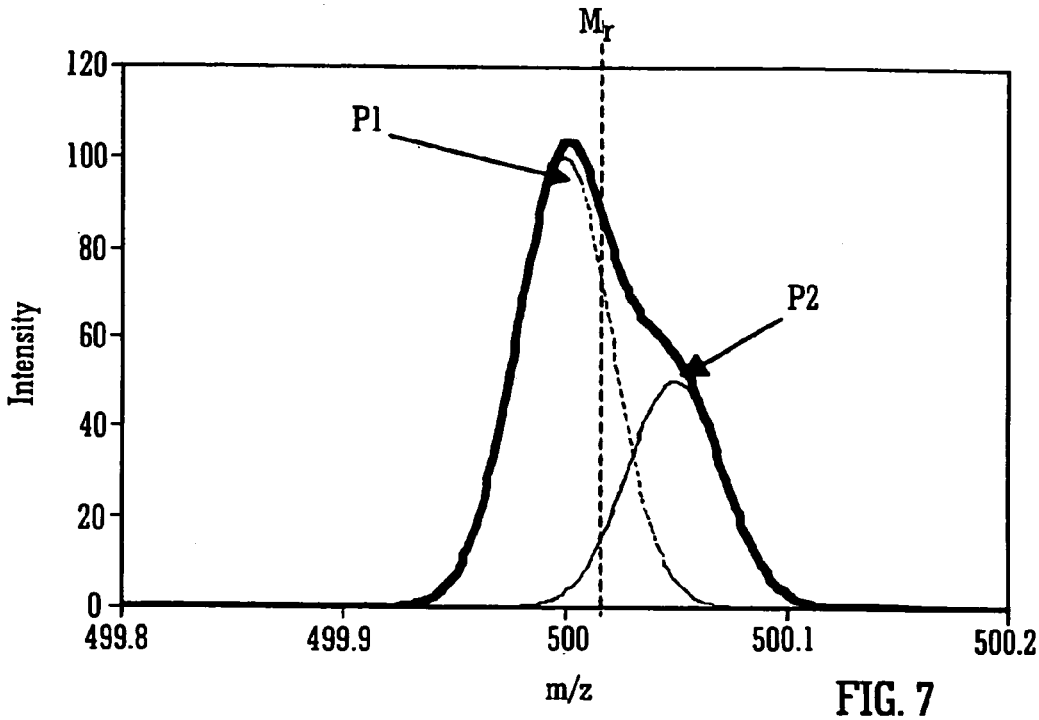
FIG. 7 shows a portion of a mass spectrum wherein two different ions can not be resolved.

FIG. 7 illustrates a scenario wherein the separation between the two different mass peaks P1, P2 has now been reduced from 0.15 mass units to only 0.05 mass units e.g. M1 is 500.0000 but M2 is now 500.0500. It is apparent that the two mass peaks P1, P2 can not now be resolved from one another. The resultant single asymmetrical mass peak shown in bold has a mean mass to charge ratio value $M_r$ of 500.0167. The first mass peak P1 may be an analyte ion which is intended to be measured whereas the second mass peak P2 may be an unexpected unresolved background or interference ion. Accordingly, the measurement of the mass to charge of the first (analyte) mass peak P1 has an error $E_{M1}$ where:

$$E=M_r-M1$$

In the particular example shown and described in relation to FIG. 7, the error E is 0.0167 da (33.4 ppm).

Mass interference effects causing systematic error can be recognized and in some cases approximately quantified by examination of the mass spectral peak shape compared to an idealized model of the expected peak shape at a particular mass to charge ratio value. This ideal peak shape may be characterized from that of standard reference peaks prior to a mass measurement. In some cases a Gaussian peak shape can be assumed. If the peak shape or width deviates beyond a pre-set criteria then the accuracy of the mass measurement of this mass to charge ratio value will be poor. The extent to which this effect can be accurately quantified will depend on the sophistication of the peak detection algorithm employed.

Another source of systematic error can result when the signal intensity recorded exceeds the operational range of a signal amplification and/or a detection device. In certain mass analysers mass measurement accuracy can also be effected by space charge repulsion within the mass analyser itself. These effects can lead to shifts in the recorded mass to charge due to, for example, distortions in mass spectral peak shape as the intensity increases. The characteristics of the particular mass analyser and detection electronics utilized should ideally be characterized prior to measurement and the upper limit of the range at which an appropriate measurement of mass accuracy can be reported found.

An additional source of systematic error can result from a change in the conditions under which the mass spectrometer is operating relative to those conditions existing when the system was calibrated. If a system parameter has changed, resulting in the calibration becoming invalid, then the final mass measurement will be in error. This situation can occur, for instance, due to user intervention, the failure of a power supply, interference from an external source of electromagnetic radiation or due to mass drift caused by ambient temperature changes. The time period which has elapsed between calibration being performed or checked using a suitable reference compound and a mass measurement being reported are preferably monitored. The longer this time period becomes the less accuracy is preferably assigned to the final measurement. Although the error on the final measurement may not be readily quantifiable it is important that effort is made to recognize this situation and reflect a general uncertainty in accuracy with any measurement presented.

To determine an overall figure of accuracy for an individual measurement, possible errors (described above) arising at each step in the mass measurement process may preferably be examined.

Errors recorded in the instrument calibration procedure have been described above. Calibrations are generally made some time before a mass measurement of an analyte is performed. Due to the susceptibility of power supplies to temperature drift and the thermal expansion of components and materials used in the construction on mass analysers it is necessary to recognise and correct for this drift over time.

To ensure that any minor drift in the instrument is accounted for when making a mass measurement an internal reference compound may be introduced at the same time or within a short time period before or after a mass measurement is made. This not only allows the calibration expression to be adjusted for any small changes but also provides an internal check of the stability of the system. For example, in a Time of Flight mass spectrometer a single point lock mass correction may be made. A reference material is introduced and the measured mass to charge ratio of a single mass spectral peak from this reference material is preferably monitored during the experiment. The empirical formula and hence the calculated mass to charge ratio for the internal calibrant is known. Changes in the overall gain of the calibration expression maybe made on a mass spectrum to mass spectrum basis. If more than one internal reference peak is present then more complex changes to the overall calibration expression may be incorporated including correction for any offset drift.

An error in the determination of the mass to charge ratio value of the internal reference will result in a error in the mass measurement of the analyte. All the sources of error previously described should preferably be estimated for the measurement of the internal reference mass to charge ratio.

In techniques where the secondary reference material is introduced at exactly the same time as the analyte compound, mass interference from background peaks or from analyte peaks may occur. In chromatographic techniques the analyte compound intensity will change with time as a chromatographic peak elutes. The internal reference compound, however, will remain at essentially constant intensity. Based on the intensity and the resolution of the internal reference peak the expected short-term scatter in the measured mass to charge ratio value for this may be calculated. If the mass to charge ratio value of the internal reference peak changes by significantly more than the calculated short-term statistical scatter it is probable that a mass interference has occurred at the internal reference peak. This could be from mass interference due to the elution of the analyte compound or due to the elution of a contaminant compound unrelated to the analyte. Alternatively, the shift may be due to an instrument parameter change, failure of a power supply, or interference from an external source of electromagnetic radiation. If this shift is greater than the statistical scatter of the internal reference measurement, then the resultant error in the accuracy of the analyte peak may be estimated and indicated. Effort must be made to differentiate between long term drift corrected by an internal reference and short term instability causing systematic measurement errors. This mass shift may characteristically occur in a similar time-scale to the chromatographic peak elution width.

Preferably, all the sources of statistical and possible systematic error previously described should be estimated for the analyte peak measurement.

In addition, using chromatographic separation techniques several mass measurements of the analyte peak are preferably made during the chromatographic elution timescale. These are subsequently averaged and presented as a final reported mass to charge ratio. It is expected that the individual measurements across the chromatographic peak will have a statistical variation based upon their individual intensities. If a set of mass measurements from a peak from an eluting compound has an exceptionally large spread of values ($\sigma$) compared to what is expected, then it may indicate the presence of interference from co-eluting or partially co-eluting compounds. In such situations no reliable estimation of accuracy may be reported.

If all the calculated errors above are determined in common units, e.g. mass units or parts per million (ppm) in mass to charge ratio, then the individual errors may be added in quadrature to yield an overall estimate of the errors associated with a single mass measurement:

$$\sigma_T=\sqrt{\sigma_1^2+\sigma_2^2+\sigma_3^2\ldots+\sigma_n^2}$$

where $\sigma_1$ to $\sigma_n$ represent the standard deviations calculated for each contribution to statistical error and $\sigma_T$ is the total calculated standard deviation on the measurement of the analyte ion mass to charge ratio. value.

The estimated accuracy of mass to charge ratio measurement is preferably recorded and optionally presented with each mass to charge ratio measurement displayed or listed in a mass spectrum. The figure reported preferably represents a scatter in multiples of $\pm\sigma_T$ about the mean value. Based upon a Gaussian distribution the confidence in the measurement presented may expressed for different multiples of $\pm\sigma_T$. The table below gives some common confidence limits derived from a Gaussian distribution.

| Range Presented | Probability of measurement falling within the range set |
|---|---|
| $\pm 0.5\ \sigma_T$ | 38.29% |
| $\pm\ \sigma_T$ | 68.26% |
| $\pm 1.5\ \sigma_T$ | 86.64% |
| $\pm 2\ \sigma_T$ | 95.43% |
| $\pm 2.5\ \sigma_T$ | 98.76% |
| $\pm 3\ \sigma_T$ | 99.73% |
| $\pm 3.5\ \sigma_T$ | 99.95% |

A figure of $\pm 2.5\ \sigma_T$ representing a 98.76% confidence level may, for example, be presented. This figure may appear as an annotation within a mass spectrum or mass spectrum list and/or may be incorporated into the output from elemental composition calculation results.

The accuracy of the measurement may also be indicated by automatically setting the number of decimal places for mass to charge ratio annotation that are presented to reflect the calculated confidence limit.

It is important not to indicate too high a level of accuracy especially when restricting the minimum ppm window used for calculation of proposed possible elemental compositions. Situations in which insufficient data is available to calculate a meaningful estimation of the overall error in mass measurement should be determined. In the preferred embodiment an estimation of calculated error will only preferably be displayed if an internal reference compound was present during the measurement or correction was made within an acceptable time frame.

The mass calibration used during the measurement should be valid. The criteria defining validity of the calibration should be determined for an individual mass spectrometer. These criteria include changes to critical instrument parameters which could affect calibration or if an unacceptable time has elapsed since the calibration was performed.

Figure 8:
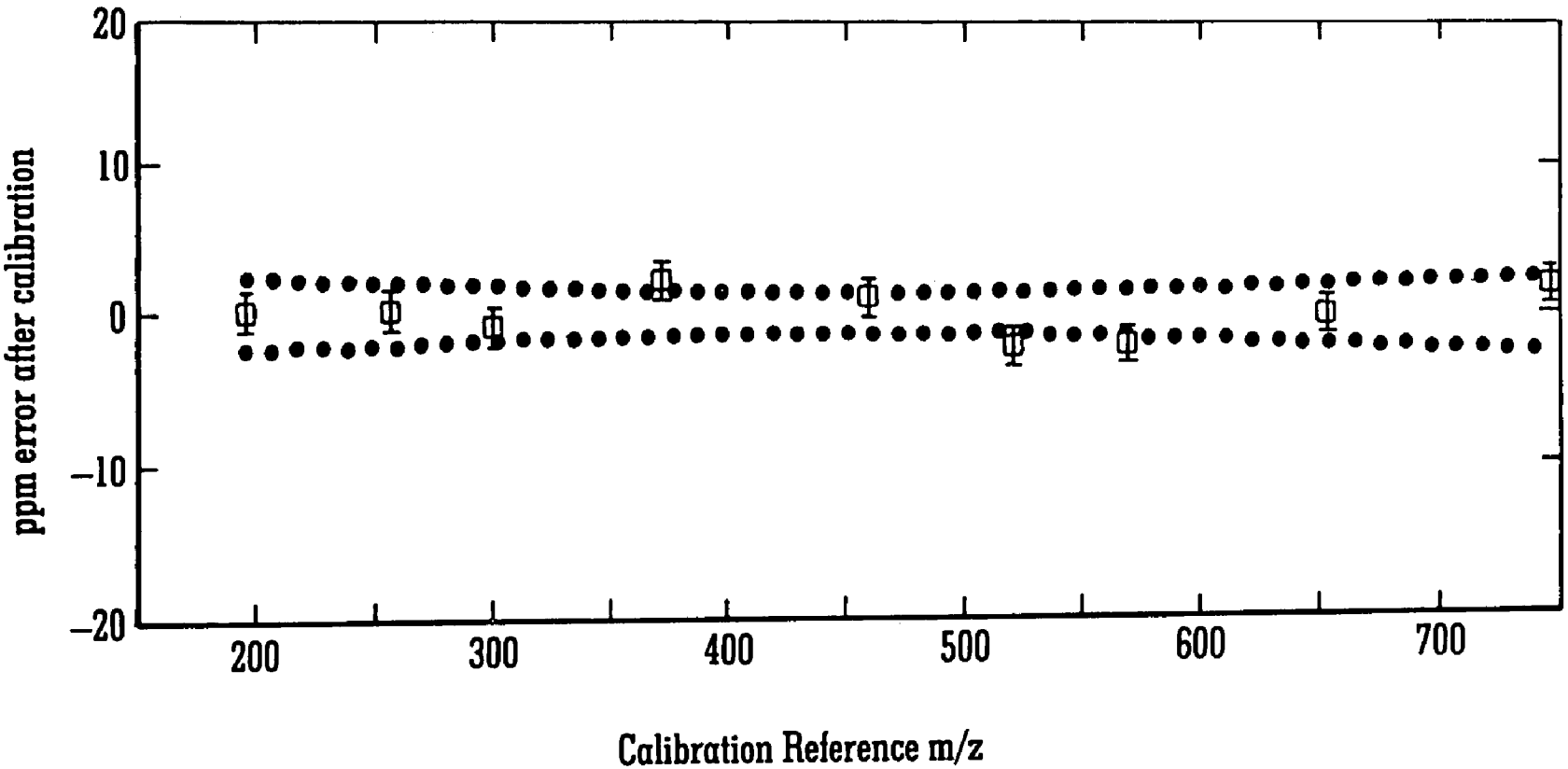
FIG. 8 shows the residual errors and calculated 95% confidence interval after calibration according to the preferred embodiment.
Figure 9:
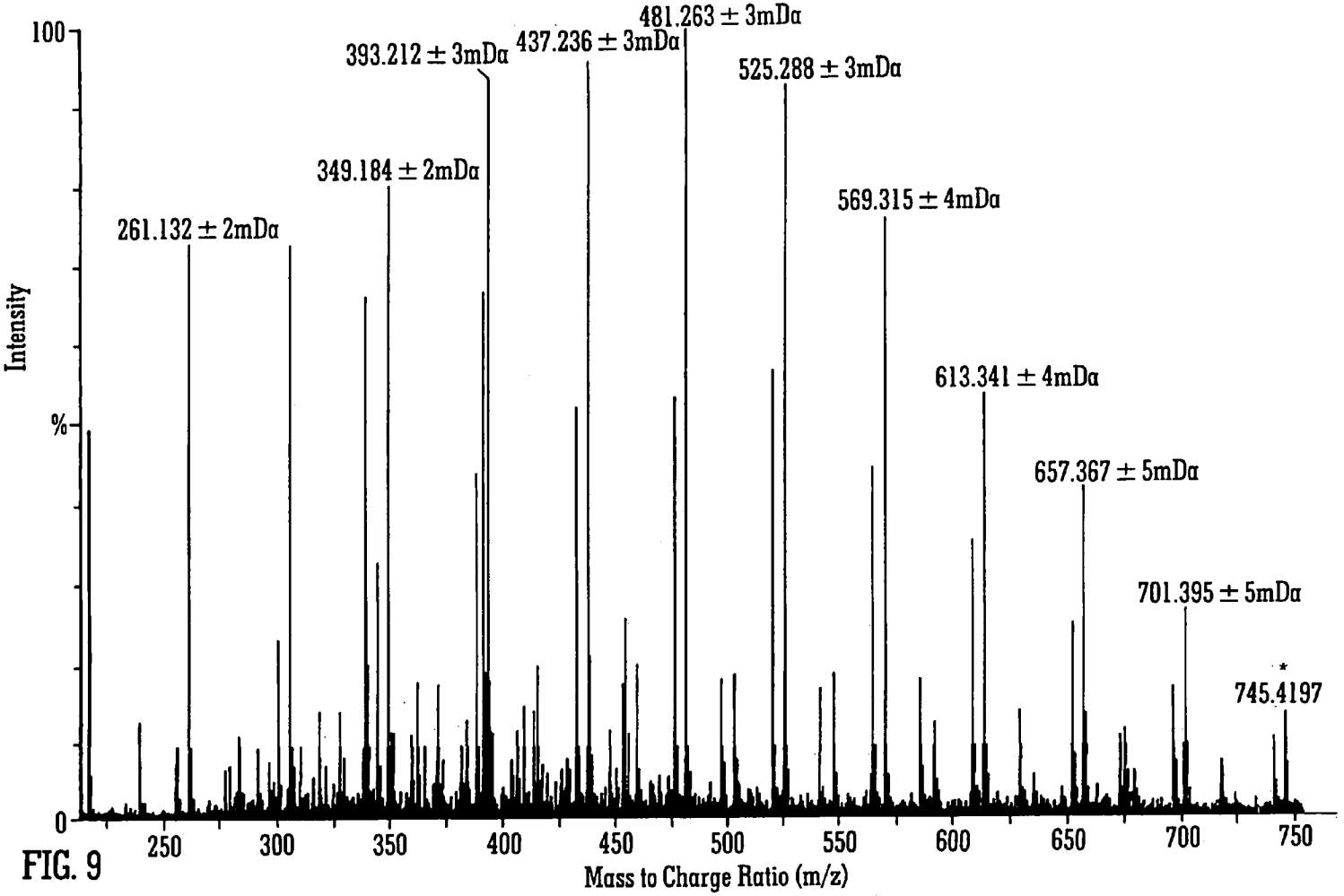
FIG. 9 shows a mass spectrum according to the preferred embodiment wherein the mass to charge ratio of individual ions together with the respective error in the determination of the mass to charge ratio of the ion is reported.

FIGS. 8 and 9 illustrate the preferred method as applied to the exact mass measurement of a mixture of Polyethylene glycols ionised using Electospray ionisation (ESI). The resulting ions were analysed using an orthogonal acceleration Time of Flight mass spectrometer. FIG. 8 shows the residual errors after calibration. The x axis represents the calculated mass to charge value of the calibrant peaks based upon their known empirical formula. The y axis represents the difference between the calibrated mass to charge values and the known reference mass to charge ratio values after calibration had been applied. The y axis is displayed in units of parts per million error (ppm). The vertical lines represent $+/-2\sigma_c$ where $\sigma_c$ is the statistical uncertainty in the peak center determination in ppm. The error bars represent the calculated scatter which could be expected from the reported mass to charge ratio from repetitive measurements of each calibration point within a 95% confidence limit. The dotted lines represent predicted 95% confidence bounds for subsequent measurements within the mass to charge ratio range of the calibration. These bounds were calculated based on the variance and covariance calculated using a third order weighted least squares linear regression.

FIG. 9 shows a mass spectrum according to the preferred embodiment of the mixture after calibration using an expression derived from the calibration shown in FIG. 8. The ion having a mass to charge ratio of 745.41977 was used as single point internal secondary reference correction and hence no error band is presented for this particular ion.

The predicted errors for each mass to charge ratio measurement were combined to provide an overall 95% confidence range for each measurement. The mass to charge values displayed in the mass spectrum shown in FIG. 9 are annotated with the predicated 95% confidence ranges and are also truncated to three decimal places to reflect the predicted precision of the measurements.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

obtaining mass spectral data using a mass spectrometer;

determining a mass to charge ratio of n different species of ion observed in said mass spectral data; and calculating a respective error band for the determined mass to charge ratio of each of said n different species of ion, wherein calculating comprises estimating a systematic error in the determined mass to charge ratio of each of n different species of ion, and the probability or confidence that the real, true, actual or accepted mass to charge ratio of each of said n different species of ion falls within its respective calculated error band is greater than or equal to x %, wherein x is $\geqq 50$.

2. A method as claimed in claim 1, wherein n falls within a range selected from the group consisting of: (i) 1; (ii) 2–5; (iii) 5–10; (iv) 10–15; (v) 15–20; (vi) 20–25; (vii) 25–30; (viii) 30–35; (ix) 35–40; (x) 40–45; (xi) 45–50; (xii) $\geqq 50$; (xiii) $\geqq 60$; (xiv) $\geqq 70$; (xv) $\geqq 80$; (xvi) $\geqq 90$; and (xvii) $\geqq 100$.

3. A method as claimed in claim 1, wherein x falls within a range selected from the group consisting of: (i) 50–55; (ii) 55–60; (iii) 60–65; (iv) 65–70; (v) 70–75; (vi) 75–80; (vii) 80–85; and (viii) 85–90.

4. A method as claimed in claim 1, wherein x falls within a range selected from the group consisting of: (i) 90–91; (ii) 91–92; (iii) 92–93; (iv) 93–94; (v) 94–95; (vi) 95–96; (vii) 96–97; (viii) 97–98; (ix) 98–99; (x) 99–99.5; (xi) 99.5–99.95; (xii) 99.95–99.99; and (xiii) 99.99–100.

5. A method as claimed in claim 1, further comprising reporting the mass to charge ratio of at least some of said n species of ion together with the respective calculated error band for each mass to charge ratio.

6. A method as claimed in claim 1, wherein said mass spectral data comprises data relating to a time that different species of ion were detected.

7. A method as claimed in claim 6, wherein said data relating to the time that different species of ion were detected is converted into data relating to the mass to charge ratio of said ions.

8. A method as claimed in claim 7, wherein said data relating to the time that different species of ion were detected is converted into data relating to the mass to charge ratio of said ions by using a calibration function.

9. A method as claimed in claim 1, wherein the step of calculating a respective error band comprises estimating the accuracy of a mathematical model used in mass calibration.

10. A method as claimed in claim 1, wherein the step of calculating a respective error band comprises estimating the error due to mass calibration.

11. A method as claimed in claim 1, wherein the step of calculating a respective error band comprises estimating the error due to using one or more internal references or calibrants.

12. A method as claimed in claim 1, wherein the step of calculating a respective error band comprises monitoring for changes in a time of detection of one or more internal references or calibrants.

13. A method as claimed in claim 1, wherein the step of calculating a respective error band comprises estimating the stability or instability of said mass spectrometer subsequent to mass calibration.

14. A method as claimed in claim 1, wherein the step of calculating a respective error band comprises estimating the error due to drift of said mass spectrometer subsequent to mass calibration.

15. A method as claimed in claim 1, wherein the step of calculating a respective error band comprises estimating the effect of changes in the operating conditions of said mass spectrometer subsequent to mass calibration.

16. A method as claimed in claim 1, wherein the step of calculating a respective error band comprises estimating the effect of user intervention subsequent to mass calibration.

17. A method as claimed in claim 1, wherein the step of calculating a respective error band comprises estimating the effect of external influences on said mass spectrometer subsequent to mass calibration.

18. A method as claimed in claim 1, wherein the step of calculating a respective error band comprises estimating the effect of the stability or instability of a power supply of said mass spectrometer subsequent to mass calibration.

19. A method as claimed in claim 1, wherein the step of calculating a respective error band comprises estimating the effect of changes in temperature on said mass spectrometer subsequent to mass calibration.

20. A method as claimed in claim 1, wherein the step of calculating a respective error band comprises estimating the effect of changes in interference subsequent to mass calibration.

21. A method as claimed in claim 20, wherein said interference is due to one or more internal reference or calibrant ions interfering with one or more analyte ions.

22. A method as claimed in claim 20, wherein said interference is due to one or more analyte ions interfering with one or more internal reference or calibrant ions.

23. A method as claimed in claim 20, wherein said interference is due to one or more background or chemical noise ions interfering with one or more internal reference or calibrant ions.

24. A method as claimed in claim 20, wherein said interference is due to one or more background or chemical noise ions interfering with one or more analyte ions.

25. A method as claimed in claim 1, wherein the step of calculating a respective error band comprises estimating a time elapsed since said mass spectrometer was last calibrated.

26. A method as claimed in claim 1, wherein the step of calculating a respective error band comprises estimating the effect of thermal expansion of one or more components of said mass spectrometer subsequent to mass calibration.

27. A method as claimed in claim 1, wherein the step of calculating a respective error band comprises estimating the error due to space charge repulsion effects within said mass spectrometer.

28. A method as claimed in claim 1, wherein the error due to space charge repulsion effects is determined at least in part by consideration of the observed intensity of one or more species of ions.

29. A method as claimed in claim 1, wherein the step of calculating a respective error band comprises estimating the error recorded during mass calibration.

30. A method as claimed in claim 1, wherein the step of calculating a respective error band comprises estimating the statistical error or random error in determining the mass to charge ratio of said ions.

31. A method as claimed in claim 1, wherein the step of calculating a respective error band comprises estimating the uncertainty or standard deviation of a time of detection of one or more species of ion.

32. A method as claimed in claim 1, wherein the step of calculating a respective error band comprises estimating the uncertainty or standard deviation of the frequency of detection of one or more species of ion.

33. A method as claimed in claim 1, wherein the step of calculating a respective error band comprises estimating the error due to ion detection statistics.

34. A method as claimed in claim 1, wherein the step of calculating a respective error band comprises estimating the error due to insufficient sampling.

35. A method as claimed in claim 1, wherein the step of calculating a respective error band comprises estimating the error due to computational errors.

36. A method as claimed in claim 1, wherein the step of calculating a respective error band comprises estimating the error due to rounding off errors.

37. A method as claimed in claim 1, wherein the step of calculating a respective error band comprises estimating the error in a report exception situation wherein one or more species of ion within said mass spectral data are sufficiently corrupted or suffering from interference that the calculated respective error band of said ions is not reported.

38. A method as claimed in claim 1, wherein the step of calculating a respective error band comprises estimating the error due to mass interference wherein background or interference ions having substantially similar mass to charge ratios to analyte ions affect the ability of resolving the analyte ions from said background or interference ions.

39. A method as claimed in claim 38, wherein the error due to mass interference is estimated by comparing the shape of an observed mass peak from said mass spectral data with the shape of a theoretical mass peak.

40. A method as claimed in claim 38, wherein the error due to mass interference is estimated by comparing the deviation of the shape of an observed mass peak with either a Gaussian distribution, a cosine squared distribution, another mathematical function, or a profile derived from the shape of one or more mass peaks of one or more internal reference or calibrant ions.

41. A method as claimed in claim 1, wherein the step of calculating a respective error band comprises estimating the error due to saturation of a detector.

42. A method as claimed in claim 1, wherein the step of calculating a respective error band comprises estimating the error due to signal amplification saturation.

43. A method as claimed in claim 1, wherein the step of calculating a respective error band comprises estimating the error due to deadtime effects or missed counts of an ion counting detector.

44. A method as claimed in claim 1, wherein the step of calculating a respective error band comprises estimating the error due to the response of an ion detector.

45. A method as claimed in claim 1, wherein the step of calculating a respective error band comprises estimating the error due to the response of an electron or photon multiplier.

46. A method as claimed in claim 1, wherein the step of calculating a respective error band comprises combining multiple estimates of different errors.

47. A method as claimed in claim 46, wherein said multiple estimates of different errors are added in quadrature.

48. A method as claimed in claim 1, further comprising searching a database to look for one or more ions known to have mass to charge ratios within a range which is related to the determined mass to charge ratio of one or more ions and the respective calculated error band for the determined mass to charge ratio.

49. A method as claimed in claim 48, wherein said database comprises details of biopolymers, proteins, peptides, polypeptides, oligionucleotides, oligionucleosides, amino acids, carbohydrates, sugars, lipids, fatty acids, vitamins, hormones, portions or fragments of DNA, portions or fragments of cDNA, portions or fragments of RNA, portions or fragments of mRNA, portions or fragments of tRNA, polyclonal antibodies, monoclonal antibodies, ribonucleases, enzymes, metabolites, polysaccharides, phosphorolated peptides, phosphorolated proteins, glycopeptides, glycoproteins or steroids.

50. A method as claimed in claim 48, wherein said database comprises details of the Electron Impact mass spectra of compounds.

51. A method as claimed in claim 1, further comprising calculating elemental compositions having mass to charge ratios within a calculated error band of the determined mass to charge ratio of one or more species of ion.

52. A method as claimed in claim 51, wherein said elemental compositions are calculated using the known masses or mass to charge ratios of atomic elements or groups of elements and/or their isotopes.

53. A method as claimed in claim 1, further comprising:

defining one or more compounds of interest; and interrogating at least some of the determined mass to charge ratios and respective calculated error bands of at least some of said different species of ion observed in said mass spectral data to see whether said one or more compounds of interest fall within the error band of at least some of said different species of ion.

54. A method as claimed in claim 1, further comprising:

defining one or more mass to charge ratios of interest; and interrogating at least some of the determined mass to charge ratios and respective calculated error bands of at least some of said different species of ion observed in said mass spectral data to see whether said one or more mass to charge ratios of interest fall within the error band of at least some of said different species of ion.

55. A method as claimed in claim 1, further comprising:

defining one or more compounds of interest; and interrogating at least some of the determined mass to charge ratios and respective calculated error bands of different species of ion observed from a plurality of mass spectra acquired over a period of time to see whether said one or more compounds of interest fall within the error band of at least some of said different species of ion observed from said plurality of mass spectra.

56. A method as claimed in claim 1, further comprising:

defining one or more mass to charge ratios of interest; and interrogating at least some of the determined mass to charge ratios and respective calculated error bands of different species of ion observed from a plurality of mass spectra acquired over a period of time to see whether said one or more mass to charge ratios of interest fall within the error band of at least some of said different species of ion observed from said plurality of mass spectra.

* * * * *